United States Patent [19]

Kure-Jensen et al.

[11] Patent Number: 4,891,948

[45] Date of Patent: Jan. 9, 1990

[54] STEAM TURBINE-GENERATOR THERMAL PERFORMANCE MONITOR

[75] Inventors: Jens Kure-Jensen, Schenectady; Harris S. Shafer, Scotia, both of N.Y.

[73] Assignee: General Electric Company, Schenectady, N.Y.

[21] Appl. No.: 814,279

[22] Filed: Dec. 23, 1985

Related U.S. Application Data

[63] Continuation of Ser. No. 563,258, Dec. 19, 1983, abandoned.

[51] Int. Cl.[4] ..... F01K 13/02

[52] U.S. Cl. ..... 60/645; 60/660; 60/670; 60/721

[58] Field of Search ..... 60/643, 645, 660, 670, 60/721

[56] References Cited

PUBLICATIONS

"Steam Turbines Performance Test Codes", ANSI/ASME PTC6-1976.

Simplified ASME Acceptance Test Procedure for Steam Turbines by B. Bornstein & K. C. Coton, 1980.

Steam Turbine Field Testing Techniques Using a Computerized Data Acquisition System, by H. S. Shafer, W. W. Kellyhouse and D. P. Smith, 1983.

*Primary Examiner*—Allen M. Ostrager

*Attorney, Agent, or Firm*—Jerome C. Squillaro

[57] ABSTRACT

A thermal performance monitor informs the operator and result's engineer of the economic losses, efficiencies, deviation in heat rates and power losses of operating a steam turbine-generator system at its controllably selected pressure and temperature. Specifically temperature and pressure signals are generated at various points in the system along with the control valve position signal and the electric output signal from the electric generator. This data is processed along with the corresponding design values and the economic losses due to temperature deviation, pressure deviation and exhaust pressure deviation from design are calculated. Other calculations produce a comparison of efficiencies of the turbines in the system and consequential power losses.

5 Claims, 10 Drawing Sheets

INITIAL PRESSURE CORRECTION FACTOR

EXHAUST PRESSURE CORRECTION FACTOR

FIG. 8

OPERATOR'S DISPLAY

DATE/TIME TURBINE IDENTIFICATION

| | | |
|---|---|---|
| TOTAL CONTROL VALVE POSITION | VI____ | % |
| TOTAL TEMPERATURE LOSS | LOSS 5____ | $/DAY |
| MAIN STEAM PRESSURE LOSS | LOSS 3____ | $/DAY |
| EXHAUST PRESSURE LOSS | LOSS 4____ | $/DAY |
| MEASURED LOAD | W 1____ | MW |

| PRESSURE | MEASURED | DEVIATION FROM DESIGN |
|---|---|---|
| MAIN STEAM | P1 | P1 - P1DES |
| FIRST STAGE | P2 | P2 - P7DES |
| COLD REHEAT | P3 | P3 - P8 DES |
| HOT REHEAT | P4 | P4 - P9DES |
| LOW PRESSURE TURBINE BOWL | P5 | P5- P10DES |
| EXHAUST | P6 | P6- P6DES |
| **TEMPERATURE** | | |
| MAIN STEAM | T1 | T1 - T1DES |
| HOT REHEAT | T4 | T4 - T4DES |

FIG. 11

RESULTS ENGINEER'S DISPLAY

DATE / TIME TURBINE IDENTIFICATION

TOTAL CONTROL VALVE POSITION V1___ %

| | HIGH PRESSURE TURBINE | INTERMEDIATE PRESSURE TURBINE |
|---|---|---|
| DESIGN EFFICIENCY | E1 ___ % | E2 ___ % |
| ACTUAL EFFICIENCY | E3 ___ % | E4 ___ % |
| DEVIATION IN HEAT RATE FROM DESIGN | H1 ___ % | H2 ___ % |

| | |
|---|---|
| TOTAL TEMPERATURE POWER LOSS | W9___ MW |
| MAIN STEAM POWER LOSS | W8___ MW |
| HIGH PRESSURE AND INTERMEDIATE PRESSURE TURBINE EFFICIENCY POWER LOSS | W2___ MW |
| EXHAUST PRESSURE POWER LOSS | W3___ MW |
| MEASURED LOAD | W1___ MW |

| PRESSURE | MS | 1ST STAGE | CRH | HRN | LPB | EXH |
|---|---|---|---|---|---|---|
| MEASURED | P1 | P2 | P3 | P4 | P5 | P6 |
| DESIGN | P1DES | P2DES | P3DES | P4DES | P5DES | P6DES |
| TEMPERATURE | | | | | | |
| MEASURED | T1 | | T3 | T4 | T5 | |
| DESIGN | T1DES | | T3DES | T4DES | T5DES | |

STEAM TURBINE-GENERATOR THERMAL PERFORMANCE MONITOR

This application is a continuation of application Ser. No. 563,258, filed Dec. 19, 1983, abandoned.

BACKGROUND OF THE INVENTION

The present invention relates to steam turbines and, more particularly, to thermal performance monitors for evaluating the instantaneous performance of steam turbine-generator systems.

Large steam turbine-generator systems represent major capital investments for their owners and their economic benefit to the owners varies with the thermal efficiency with which the steam turbines are operated. To highlight the importance of thermal efficient operation, it is believed that a difference of one percent in the efficiency of a steam turbine driving a one gigawatt electric generator is worth on the order of tens of millions of dollars over the life of the unit. Thus, the owners of a large steam turbine-generator are vitally interested in maintaining the operating parameters of the system as close as possible to the optimum set of operating parameters as designed for the system, and/or developed during operational testing following initial installation of the system, since departure from these parameters tends to reduce the thermal efficiency. In addition, unavoidable degradation in performance over time can occur due to deterioration of internal parts and other causes. Means for detecting the onset and severity of such deterioration is useful. Furthermore, it is desirable to monitor the turbine for internal problems, especially the type which necessitate rapid detection thereby permitting timely action to be taken.

Despite the importance of maintaining the operating parameters at levels which maximize thermal efficiency, in normal practice, encompassing the minute-to-minute control of the controllable parameters of a large steam turbine, the turbine shift operators customarily maintain such operating parameters at values close to optimum levels but still far enough different from the optimum to produce substantial efficiency deviations which result in cost penalties. Additionally, conventional power station instrumentation does not provide a class of information which has either the accuracy or the information content to guide an operator in adjusting and keeping a steam turbine at its best performance levels. In fact, it is possible, during the attempt to optimize system performance using monitoring systems of the prior art, for the shift operator to make adjustments which, instead of changing the operating parameters in the direction of improved efficiency, change the operating parameters in directions resulting in degraded efficiency.

As part of the installation procedure of a steam turbine-generator subsystem, it is customary for the owners and/or the contractor or turbine manufacturer to conduct very accurate tests to demonstrate or determine the heat rate of the system. Heat rate is a measure of thermal efficiency of a steam turbine-generator system defined as the number of units of thermal input per unit of electrical power output. In one convenient system of units, heat rate is measured in BTUs per kilowatt hour of power output. One standard test of heat rate is known as the ASME test and is defined in an ASME publication ANSI/ASME PTC 6 - 1976 Steam Turbines. A simplified ASME test is described in *A Simplified ASME Acceptance Test Procedure for Steam Turbines*, presented at the Joint Power Conference, Sept. 30, 1980, in Phoenix, Ariz. A requirement and characteristic of both of the above tests is accurate instrumentation for temperatures, pressures and flows within a steam turbine along with the resulting generator power output to determine accurately the energy content of such conditions and the resulting power output. The accuracy of measurement is sufficiently great that no measurement tolerance need be applied to the results. Such tests are costly to perform. For example, the standard ASME test requires a substantial installation of specialized measuring equipment at a substantial cost in conjunction with a great amount of manpower to administer the test. Thus, economic reality keeps the administration of such tests limited to the initial commissioning of a new steam turbine-generator system and (less frequently) to the recommissioning of a steam turbine-generator system at a subsequent time after a refurbishment.

Besides their cost, ASME-type tests have the additional drawback that they are not suitable for use in day-to-day operation of a steam turbine-generator system. The types of instrumentation required may not retain useful accuracy over extended periods. In addition, even if such testing could be conducted on a substantially concurrent, instantaneous and daily basis, the type of information conventionally produced during such tests, although invaluable in the initial engineering evaluation of the system, is of a type which requires such substantial interpretation and calculation to derive control adjustments that it is, at best, of marginal value in guiding an operator in manipulating the controls which are available to him.

Customarily, the shift operator, directly controlling the steam turbine system, does not have the time, the inclination, nor the sophistication to reduce the technical results of the ASME-type tests into an understandable format on a substantially instantaneous basis. His primary function is to monitor the turbine-generator performance as it relates to other turbine-generator sets tied into the electrical transmission system. In this view, a thermal performance monitor must gather relatively instantaneous data from the turbine-generator system and present a limited amount of information to the shift operator in a very concise, quickly readable and understandable format, such that the operator can adjust the turbine-generator set to operate more efficiently.

In contrast, a results engineer reviews the periodic performance statistics for the turbine-generator set in a more sophisticated and detailed manner. Since the results engineer's attention is not immediately focused on the steam pressures and temperatures and other parameters affecting the turbine, he can leisurely proceed with a more detailed analysis of the turbine's operation. From the results engineer's perspective, a detailed presentation at a much higher technical level of the thermal performance of each major component in the steam turbine-generator system is desirable. As an example, the detailed thermal performance data compiled, throughout one week of turbine operation, may illuminate an incipient problem with the steam condensor as reflected in an increased exhaust pressure value. By focusing his attention on the exhaust pressure vis-a-vis the other components of the turbine over an extended period of time, e.g., 2 months, the results engineer could approach the owners of the turbine-generator unit with a request for a cleaning or modification of the condensor. Further trend analysis would be facilitated by a sophisticated thermal performance monitor.

ASME-type testing can, however, be relied on initially to produce reference or a design data base from which optimum sets of operating parameters and the related heat rates and other parameters throughout a new steam turbine-generator system can be derived. Once such optimum sets of operating data are established, operating parameters during later operation of the system may be compared to it for determining correct operation of the system.

OBJECTS AND SUMMARY OF THE INVENTION

Accordingly, it is an object of the invention to provide an apparatus for guiding optimum operation of a steam turbine-generator system.

It is a further object of the invention to provide an apparatus for instrumenting a steam turbine-generator system and for producing an output which may be used on a substantially instantaneous basis to control the controllable parameters of the steam turbine and obtain improved system efficiency.

It is a still further object of the invention to provide an apparatus for instrumenting a steam turbine-generator system and for producing an output effective for directly informing an operator of the economic consequences of an existing set of operating parameters and for guiding the operator toward modifying the operating parameters in a direction tending to improve the system efficiency.

It is an additional object of this invention to provide for means for informing the results engineer of detailed information and analysis regarding each major component in the steam flow path of the turbine-generator system.

It is a further object of the invention to provide an apparatus for instrumenting a steam turbine-generator system which is effective to monitor and display the thermal performance of each major component in the steam flow path of the turbine-generator system.

SUMMARY OF THE INVENTION

A steam turbine-generator thermal performance monitor includes several sensors for measuring the pressure and temperature of the steam in a steam turbine generator system. The position of the steam admission control valve is also sensed. An operator's thermal performance monitor obtains the pressure and temperature upstream of the control valve and the exhaust pressure of the steam downstream of the turbine. A power output signal from the electric generator is obtained and a means for determining the percentage of rated load at which the turbine is instantaneously operating at is also provided. An initial temperature heat rate correction factor is generated, in addition to an initial pressure heat rate correction factor and an exhaust pressure heat rate correction factor. Means for determining the substantially instantaneous design heat rate for the turbine-generator system is provided which is based upon the temperature and pressure signals, the control valve position signal, and the design pressure and temperature values for the steam turbine. A main steam temperature loss signal is generated by multiplying the first temperature heat rate correction signal, the power signal, the design heat rate signal, and a signal representative of the cost per unit heat factor of operating the steam generator in the turbine-generator system. The main steam temperature loss signal is displayable in cost per unit time to the turbine operator. A steam pressure loss signal, also displayable in cost per unit time, is generated in a similar fashion utilizing a pressure heat rate correction signal and other signals. An exhaust pressure loss signal is generated by utilizing the exhaust pressure heat rate correction signal and similar signals. The operator's monitor includes means for displaying, on a substantially continuous basis, the main steam temperature loss signal, the steam pressure loss signal and the exhaust pressure loss signal, all in cost per unit time format. This presentation informs the operators of the economic consequences of operating the turbine at the controllably selected temperature and pressure and at a certain exhaust pressure.

The steam turbine-generator system may include a first, a second and a third turbine and additional temperature and pressure signals are generated and supplied to the monitor. A reheat steam temperature loss signal, displayable in cost per unit time, is summed with the first steam temperature loss signal to provide a total steam temperature loss signal. The displaying means presents the total steam temperature loss signal, in the cost per unit time format, to the operator of the steam turbine generator system.

A results engineer's thermal performance monitor measures the substantially instantaneous temperature and pressures throughout the steam turbine system. An actual enthalpy drop and an isentropic enthalpy drop is calculated for the first, or high pressure turbine (hereinafter the HP turbine), and the second, or intermediate pressure turbine (hereinafter the IP turbine) The substantially instantaneous design efficiency for the HP turbine is calculated based upon the first temperature, first pressure, and the control valve position, in addition to the design pressure and temperature values for the HP turbine. The IP turbine has an installation dependent constant for its design efficiency. The actual efficiencies of the HP and IP turbine are calculated based upon the ratio of the actual enthalpy drops and the isentropic enthalpy drops. A pair of deviation in heat rate from design calculators generate appropriate signals for the HP and IP turbine respectively. Means for presenting the actual efficiencies of the HP and IP turbine, the design efficiencies of the HP and IP turbine, and the HP and IP deviations in heat rate from design allows the results engineer to identify the overall performance of the turbine at a particular time.

The results engineer's thermal performance monitor may also include means for calculating a main steam temperature power loss, a main steam pressure power loss, a reheat steam temperature power loss, a turbine efficiency power loss, and an exhaust pressure power loss. These power loss signals are presented to the results engineer and provide a basis for altering the operating parameters of the steam turbine-generator system, effecting the maintenance of the system or recommending modifications of the system.

BRIEF DESCRIPTION OF THE DRAWINGS

The subject matter which is regarded as the invention is particularly pointed out and distinctly claimed in the concluding portion of the specification. The invention, however, together with further objects and advantages thereof, may be best understood by reference to the following description taken in connection with the accompanying drawings in which;

FIG. 8 illustrates an operator's display for the operator's thermal performance monitor;

FIG. 11 illustrates a result engineer's display for the thermal performance monitor.

DETAILED DESCRIPTION OF AN EMBODIMENT

The principal controls available to a shift operator of a steam turbine-generator system include boiler controls which determine the temperature and pressure of the main steam and reheat steam supplies and a main steam admission control valve or valves which determines the amount of steam admitted to the first or high pressure turbine stage. Practical guidance to an operator of such a steam turbine-generator system includes evaluations of the substantially instantaneous operating parameters in a manner which can be interpreted easily, quickly and without detailed technical analysis to facilitate the manipulation of these principal controls.

Figure 1:
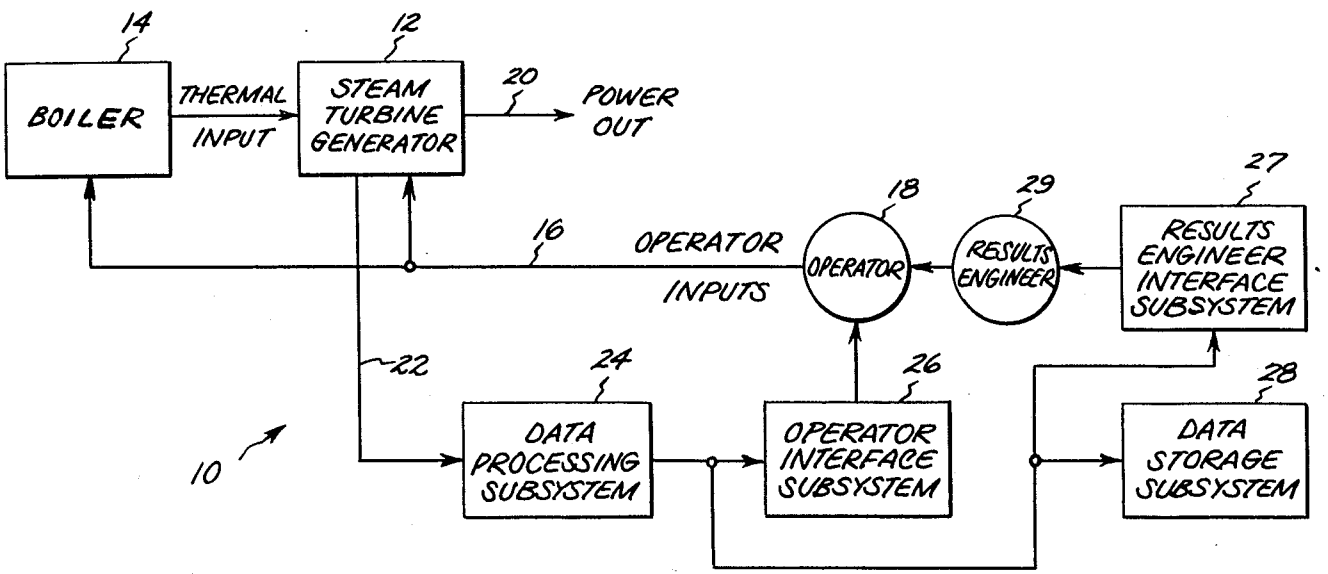
FIG. 1 is a simplified block diagram of a steam turbine-generator system according to an embodiment of the invention.

Referring now to FIG. 1, there is shown, generally a steam turbine-generator system 10. Steam turbine-generator system 10 includes a steam turbine-generator 12 receiving a thermal input from a steam boiler 14. Boiler 14 may be of any convenient type, such as coal-fired or oil-fired. Both steam turbine-generator 12 and boiler 14 are controlled by operator inputs represented by a line 16 from an operator 18 to produce an electric power output represented by a line 20. A set of measured parameters from steam turbine-generator 12 are applied on a line 22 to a data processing subsystem 24. As will be more fully discussed hereinafter, the types of measured parameters are those which can be obtained with sufficient reliability and accuracy over the long term and which can be interpreted by data processing subsystem 24 in a fashion which can guide operator 18 in controlling steam turbine-generator 12 and boiler 14 on a minute-by-minute basis. The outputs of data processing subsystem 24 are applied to an operator interface subsystem 26 which may be of a conventional type such as, for example, a cathode ray tube display, a printer or other types of analog or digital display devices. The output from data processing subsystem 24, may also be applied to a data storage subsystem 28 wherein the data may be stored for short-term or long-term purposes. Data storage subsystem 28 may be of any convenient type including a printer, however, in the preferred embodiment, data processing subsystem 24 includes a digital processor and data storage subsystem 28 preferably includes a digital storage device such as, for example a magnetic or optical disc or a magnetic tape storage device.

Coupled parallelly with operator interface subsystem 26 is a results engineer interface subsystem 27. Interface 27 allow a results engineer 29 to study the outputs of data processing subsystem 24 on a more leisurely basis as compared with operator 18. Results engineer 29 communicates with operator 18 to improve the long-term performance of turbine-generator system 10 due in part to the higher level, sophisticated analysis with which the engineer views the data. The engineer also determines the maintenance procedures for the system and subsystem 27 assists in the promulgation of those procedures.

Figure 2:
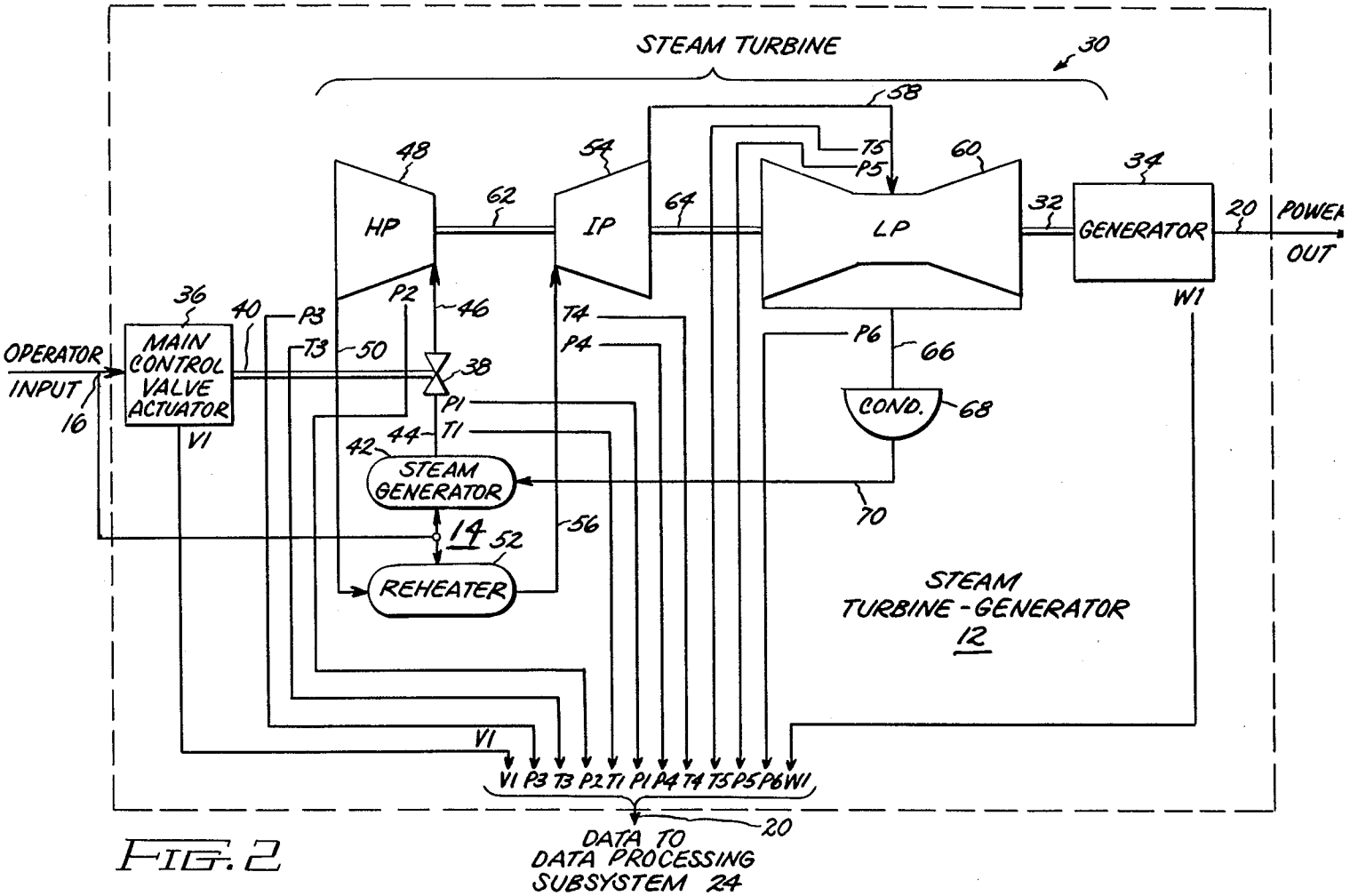
FIG. 2 is a simplified schematic diagram of a steam turbine-generator showing monitoring points employed in the present invention.

Referring now to FIG. 2, a simplified schematic diagram of steam turbine-generator 12 is shown including only sufficient detail to fully disclose the present invention. Steam turbine-generator 12 is conventional except for the measurement devices installed therein to support the present invention. Thus, a detailed description of steam turbine-generator 12 is omitted. In general, the present invention relies on temperature and pressure measurements at various locations throughout steam turbine-generator system, including a measurement of the generated electrical power output and compares their relationship to corresponding design values to determine the power losses, efficiencies and heat rates throughout the system on a substantially instantaneous basis.

Steam turbine-generator 12, of FIG. 1, consists of a steam turbine 30 coupled through a mechanical connection 32, to an electric generator 34 which generates an electric power output. A transducer (not shown) in electric generator 34 produces an electric power output signal W1 which is applied to line 22 for transmission to data processing subsystem 24. The operator input on line 16 is applied by hydraulic, electrohydraulic, digital or other well known means, to a main control valve actuator 36 which affects a main control steam admission valve 38 as illustrated by line 40. A valve position signal V1, is generated by appropriate means and represents the amount by which main control valve 38 is opened, and the signal is applied to line 22 for transmission to data processing subsystem 24. It is to be understood that valve 38 is representative of a number of steam admission control valve commonly associated with a steam turbine.

A steam generator 42, which is part of boiler 14, produces a supply of hot pressurized steam which is applied to main control valve 38 on a line 44. The steam passing through main control valve 38 is applied on a main steam line 46 to an input of a high pressure turbine 48. As utilized herein, the term "HP" refers to high pressure turbine 48. The steam exiting from HP turbine 48, now partially expanded and cooled, but still containing substantial energy, is applied on a cold reheater line 50 to a reheater 52 which is also part of boiler 14. The pressure and temperature of the steam in line 44, upstream of main control valve 38 and generally at its inlet are measured by sensors (not shown) to produce a representative first pressure signal P1 and a first temperature signal T1 which are transmitted to data processing subsystem 24. The pressure and temperature of the steam in cold reheater line 50, downstream of high pressure turbine 48 at substantially its exit, are measured by sensors (not shown) to produce a representative third pressure signal P3 and a third temperature signal T3 which are also transmitted to data processing subsystem 24.

A pressure sensor (not shown) produces a pressure signal P2, representing the pressure sensed proximate the first stage of HP turbine 48, and the signal is transmitted to data processing subsystem 24.

An intermediate pressure turbine 54 (hereinafter "IP" turbine) receives reheated steam from reheater 52 on a hot reheater line 56, expands the steam to extract energy from it and exhausts the steam through an exhaust line 58 to a low pressure turbine 60. Mechanical outputs of HP turbine 48, IP turbine 54 and low pressure turbine 60 (hereinafter "LP" turbine) are interconnected mechanically as shown by coupling means 62 and 64 which are, in turn, mechanically coupled to connection 32 and to the generator 34. A fourth temperature T4 and pressure P4 in hot reheater line 56, upstream of IP turbine 54 are measured by sensors (not shown) and represenative signals are transmitted to data processing subsystem 24. In addition, a fifth temperature T5 and pressure P5 of the steam in line 58, downstream of IP turbine 54, is measured by sensors (not shown) and signals representing those quantities are also transmitted to data processing subsystem 24. In another embodiment, T5 and P5 are measured at the low pressure bowl of LP turbine 60.

Exhaust steam from LP turbine 60 is applied on a line 66 to a condenser 68 wherein the steam is condensed to water and thereafter conveyed on a line 70 to steam generator 42 for reuse. One of the factors which can degrade system efficiency is deficient operation of condenser 68 which can result in higher than normal back pressure at the exhaust of low pressure turbine 60. Such back pressure is an indication that the operation of condenser 68 requires adjustment for improved efficiency. A pressure sensor (not shown) in line 66 produces an exhaust pressure signal P6 which is transmitted to data processing subsystem 24 for further processing and display.

It should be noted that the temperature sensors used may be of any convenient type, however, in the preferred embodiment, each temperature sensor includes a plurality of high accuracy chromel constantan (Type E) thermocouples disposed in a well and positioned to give access to the steam whose temperature is to be measured. By using a plurality of thermocouples for each sensor, the results from the plurality of thermocouples may be averaged to substantially reduce individual thermocouple errors or minor differences in system temperatures. In addition, the availability of more than one thermocouple offers a measure of redundancy in case of failure of one or more of the thermocouples at a sensor location. Transmission of the temperature signals may be accomplished using analog voltages or the temperature signals may be digitized before transmission to make the measurements less susceptible to the lengths of cable runs and to noise. Similarly, the pressure sensors may be of any convenient type such as, for example, pressure sensors commercially available under the name Heise Model 715T having appropriate pressure, accuracy and environmental temperature ranges.

Figure 3:
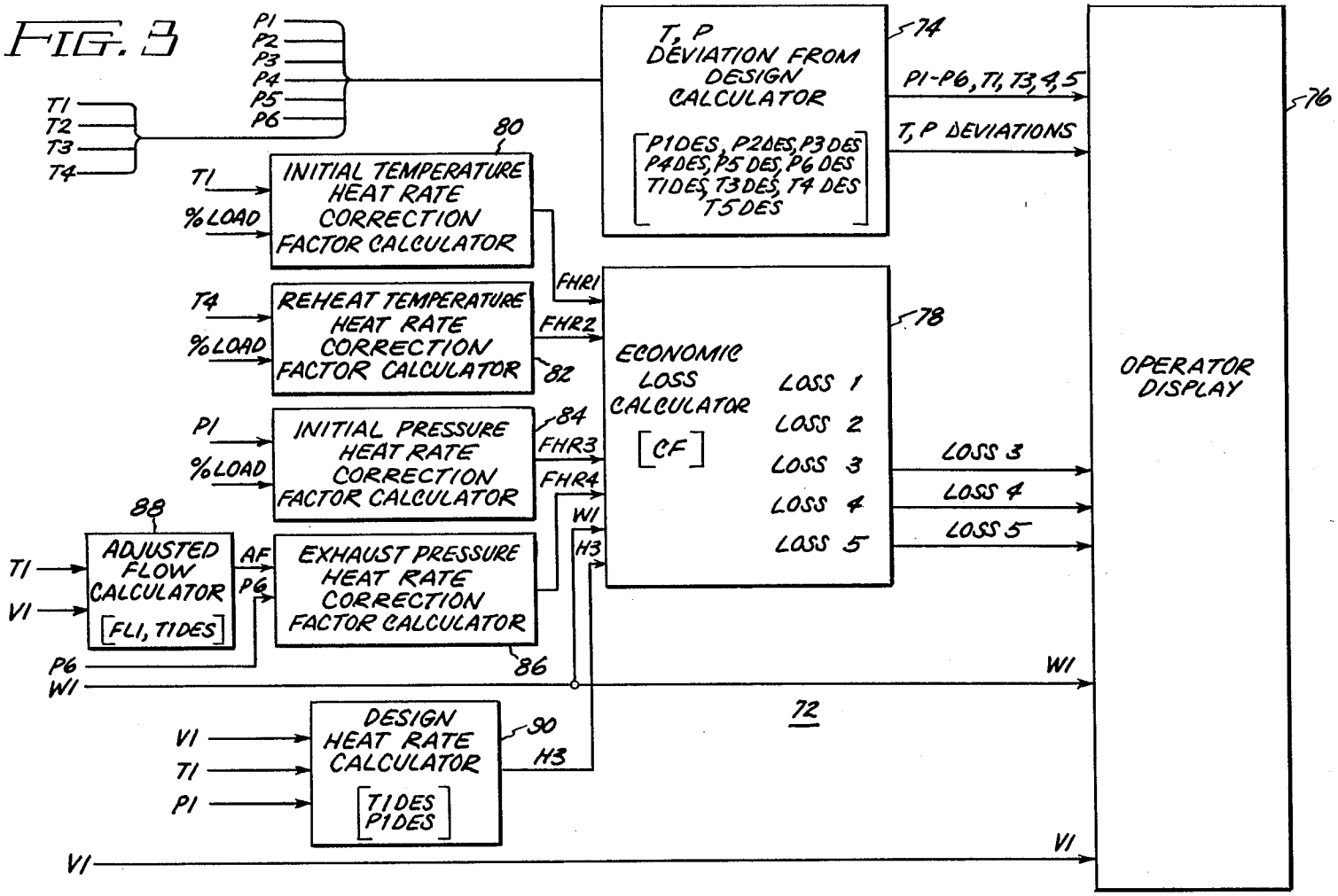
FIG. 3 is a flow chart illustrating the functional aspects of an operator's thermal performance monitor as part of the data processing subsystem of FIG. 1.

Referring now to FIG. 3, there is shown the flow chart for the principal elements making up an operator's thermal performance monitor 72 as part of data processing subsystem 24. The flow chart functionally describes the various components in the operator's thermal performance monitor 72. Beginning at the top left hand corner of FIG. 3, temperature and pressure inputs are supplied to monitor 72. All the temperature and pressure inputs are supplied to a temperature and pressure deviation from design calculator 74. Calculator 74 has a data base therein which maintains the design temperature and pressure values for each sensed temperature and pressure signal. Hence, pressure P1, sensed at the inlet of control valve 38, has a corresponding first design pressure value, P1DES. Similarly, temperatures T1, T3 etc., have corresponding design temperature values T1DES, T3DES, etc. These design pressure and temperature values are illustrated within the brackets of calculator 74. The steam temperature and pressure design values are established by the turbine-generator manufacturer or are established during the initial commissioning of the turbine-generator unit. The substantially instantaneous temperatures and pressures sensed throughout the turbine-generator system are displayed to the operator by operator display 76. Calculator 74 subtracts the design values from their corresponding instantaneously sensed signals to obtain temperature and pressure deviations from design. The temperature and pressure deviations from designs are supplied to operator display 76.

It is important to note that the operator display 76 is part of operator interface subsystem 26 and that the subsystem must present information in a simplified, easily understood fashion to operator 18. As is commonly recognized in the art, operator 18 is responsible for overseeing several other major control systems in the turbine-generator system. Hence, operator display 76 presents very refined information based upon certain operating parameters, i.e., selected temperature and pressures, to the operator.

Central to the data processing of the raw temperature and pressure data, is an economic loss calculator 78. Basically, economic loss calculator 78 has supplied to it several heat rate correction factors, the electrical power output signal W1, and a design heat rate signal H3. As will be described later, loss calculator 78 manipulates this information and presents specific economic loss figures, in a cost per unit time format, which is normally dollars per day, to the operator through operator display 76.

Specifically, an initial temperature heat rate correction factor signal FHR1 is generated by an initial temperature heat rate correction factor calculator 80. Calculator 80 obtains signal T1 and a signal representative of the substantially instantaneous percentage of rated load at which the system is operating. The signal is illustrated herein as "%LOAD". The percentage of rated load signal is easily computed and is well known in the art. The initial temperature heat rate correction factor, FHR1, is a function of T1 and %LOAD signal. The initial temperature function is a relationship between the deviation of T1 from the design temperature value T1DES which results in a percentage change in a design heat rate value.

Figure 4:
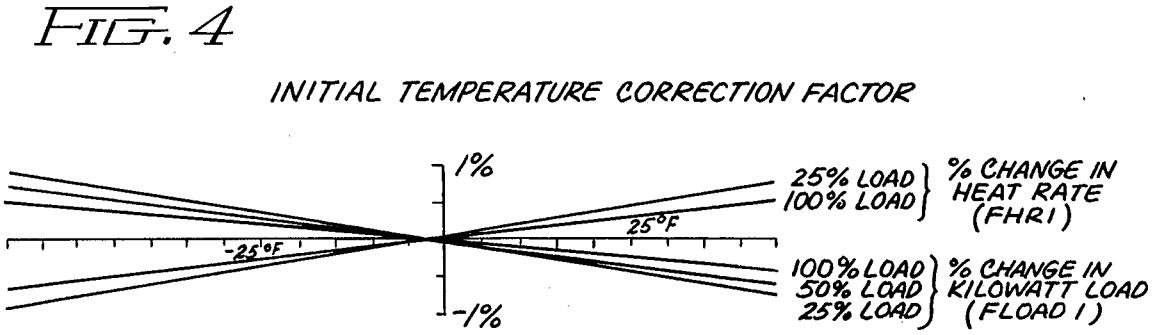
FIG. 4 is an exemplary Initial Temperature Correction Factor Graph.
Figure 5:
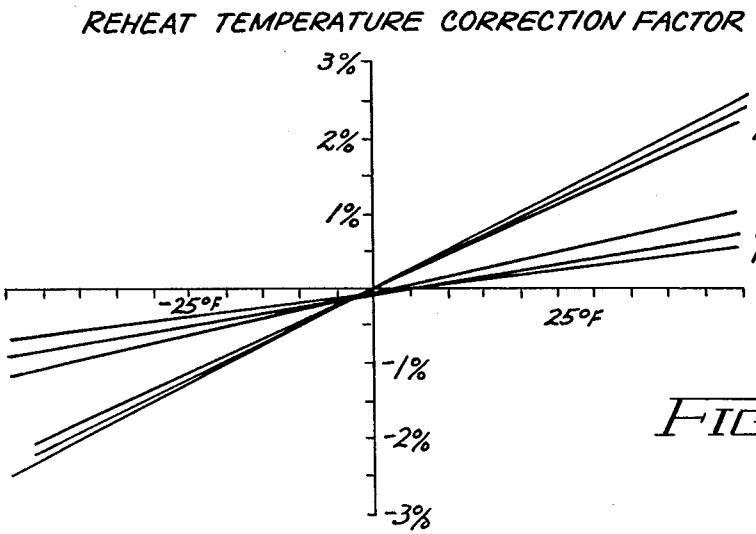
FIG. 5 is an exemplary Reheat Temperature Correction Factor Graph.
Figure 6:
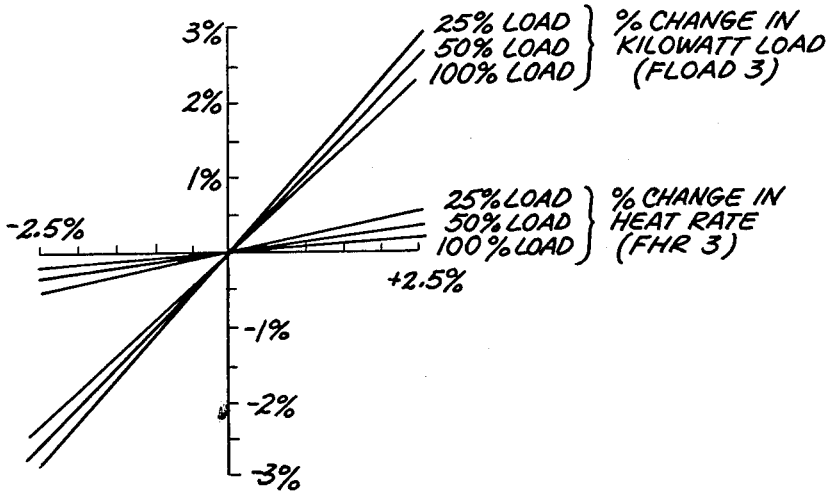
FIG. 6 is an exemplary Initial Pressure Correction Factor Graph.
Figure 7:
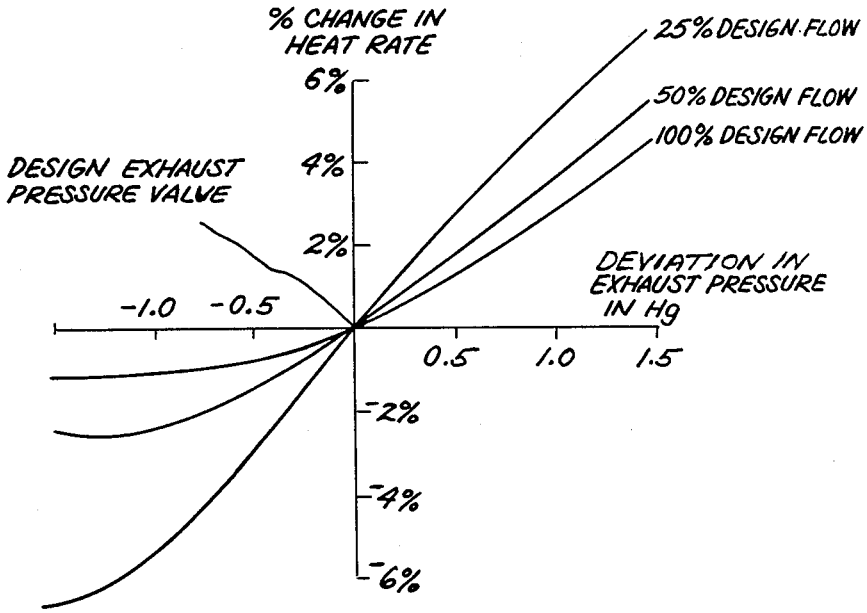
FIG. 7 is an exemplary Exhaust Pressure Correction Factor Graph.

FIG. 4 graphically illustrates the initial temperature correction factor values for an exemplary system. FHR1 is illustrated by the lines extending through the lower left quadrant and into the upper right quadrant. As illustrated therein, the slope of the initial temperature function is affected by the percentage of rated load. The initial temperature correction factor graph, as well as the reheat temperature correction factor graph of FIG. 5, the initial pressure correction factor graph of FIG. 6, and the exhaust pressure correction factor graph of FIG. 7 are based upon theoretically calculated data relating to a certain group of steam turbines and verified by testing of actual steam turbines. These graphs are well known in the art. As is well known in the art, the graphs illustrated in FIGS. 4, 5, 6 and 7 are supplied by the turbine-generator manufacturers normally at the time the turbine-generator system is sold to the utility company or owners of the system. The graphs illustrated herein relate only generally to a system schmetically shown in FIG. 2.

As is well recognized in the art, HP turbine 48 has an associated design temperature T1DES at which a design heat rate value should be attained. When T1 deviates from T1DES, the heat rate changes graphically as illustrated in FIG. 4.

A reheat temperature heat rate correction factor calculator 82, of FIG. 3, provides means for determining a corresponding signal, FHR2, which is a function of T4 and %LOAD. IP turbine 54 should be operated at a specific design temperature, i.e., T4DES, hence, the FHR2 factor is a percentage change in heat rate as displayed graphically by the lesser sloped lines in FIG. 5.

An initial pressure heat rate correction factor, FHR3, calculator 84 is supplied with pressure P1 and the %LOAD signal as illustrated in FIG. 3. The FHR3 signal is a function of P1, %LOAD, and the design pressure value for HP turbine 48, P1DES. Graphically, the FHR3 correction factor is illustrated in FIG. 6. Basically, HP turbine 48 is designed to operate at a design pressure P1DES and deviations from that design pressure affect the heat rate. As clearly illustrated in FIG. 3, the FHR1 signal, the FHR2 signal, and the FHR3 signal are supplied to economic loss calculator 78. All the signals are percentage changes in heat rate from design and are related to the deviation from design of certain operating parameters.

Generally, the overall performance of the turbine-generator system is affected by the back pressure or exhaust pressure present at the exit of the last turbine in the system. Hence, LP turbine 60 has a sensor located on line 66 to determine exhaust pressure P6. P6 is supplied to exhaust pressure heat rate correction factor, FHR4, calculator 86 as is an adjusted flow signal AF from an adjusted flow calculator 88. AF signal can be calculated in many ways as is commonly recognized in the art. One method of calculating adjusted flow AF is based upon T1, V1 (the position of steam admission control valve 38), P1, P1DES, the steam design flow value FL1, and T1DES. One algorithm to obtain the adjusted flow signal AF is as follows:

$$AF=FL1*[(T1+460)/(T1DES+460)]^{-\frac{1}{2}}*P1/P1DES$$

where FL1 is in pounds per hour and T1, T1DES is in degrees Fahrenheit and AF is in pounds per hour.

The AF signal and the exhaust pressure signal P6 is applied to calculator 86. FIG. 7 graphically illustrates an exemplary function for determining the factor FHR4. The FHR4 factor is a relationship between the deviation of P6 from a design exhaust pressure value P6DES which results in a percentage change in the design heat rate value for the turbine-generator system. As illustrated in FIG. 7, the instantaneous slope of the exhaust pressures affected by the ratio of adjusted flow AF to the design flow value FL1. The ratio provides the percentage of design flow. Signal FHR4 is supplied to economic loss calculator 78.

As is well known in the art, the turbine-generator system has associated with it a design heat rate value at a specific percentage of rated load. The design heat rate value for the turbine-generator system is dependent in part upon the turbine being supplied with steam at design temperature T1DES and design pressure P1DES. Hence, when P1 and T1 deviate from the design values, the design heat rate for the turbine system changes. A design heat rate calculator 90 provides means for determining the substantially instantaneous design heat rate H3 for the system including the turbine and the electric generator. A design heat rate signal H3 is generated by calculator 90. The control valve signal V1, signal T1 and signal P1 are supplied to calculator 90. The H3 signal is related to a corrected percentage of flow (PCF2) through the turbine system, and by comparing PCF2 to a data base developed by the turbine-generator manufacturer at or after the initial testing at the commissioning of the turbine-generator unit, the design heat rate signal H3 is obtained. PCF2 can be calculated by many well known methods, one of which follows from the equation:

$$PCF2=f(V1)*[(P1/VOL(P1,T1))/(P1DES/VOL(P1DES,T1DES))]^{\frac{1}{2}}$$

where f(V1) is the percent steam flow through the control valve, VOL(P1,T1) is the specific volume of the steam at the pressure and temperature P1, T1, and VOL(P1DES, T1DES) is the design specific volume of the steam at design pressure and design temperature values. It is well known in the art how to determine percent steam flow through the control valve as a function of V1.

Calculator 78 obtains FHR1 signal, FHR2 signal, FHR3 signal, FHR4 signal, electrical output signal W1, and H3 signal. Calculator 78 has stored within it a cost per unit heat factor CF at which the system operates. In other words, boiler 14 outputs heat or thermal energy at a certain cost per unit heat, such as in dollars per million BTU. Generally, calculator 78 includes means for multiplying the several inputs together along with several conversion constants thereby developing economic loss signals displayable in cost per unit time. A main steam temperature loss signal LOSS1 is developed by multiplying W1, FHR1, H3 and the cost per unit heat factor signal CF, together with a first constant. With respect to the steam turbine system under discussion herein which includes HP turbine 48, IP turbine 54 and LP turbine 60, the main steam temperature loss signal LOSS1 is added to a reheat steam temperature loss signal LOSS2 to obtain a total temperature loss signal LOSS5. As is well recognized in the art, if the steam turbine system included only one turbine mechanically coupled to an electromagnetic generator, main steam loss signal LOSS1 would be directly displayed to the operator of that single turbine system.

One algorithm for determining the main steam temperature loss signal LOSS1 is as follows:

$$LOSS1=(FHR1(T1,\%LOAD)/100)*H3*10^{-3}*W1*10^{6}*24*CF*10^{-6}$$

In the above equation, the main steam temperature loss signal LOSS1 is displayable in dollars per day.

The reheat steam temperature loss signal LOSS2 represents the economic loss of operating IP turbine 54 at a temperature and pressure different from the design temperature and pressure. One algorithm for determining the reheat steam temperature loss signal LOSS2 is as follows:

$$LOSS2=(FHR2(T4,\%\ LOAD)/100)*H3*10^{-3}*W1*10^{6}*24*CF*10^{-6}$$

The economic loss of operating the steam turbine system 30 at a certain pressure is provided by a main steam pressure loss signal LOSS3 which is derived from the equation:

$$LOSS3=(FHR3(P1,\%\ LOAD)/100)*H3*10^{-3}*W1*10^{6}*24*CF*10^{-6}$$

An exhaust pressure loss signal LOSS4 relates the economic loss of operating the steam turbine system at an exhaust pressure P6, and one equation for determining the exhaust pressure loss signal LOSS4 is as follows:

$$LOSS4=(FHR4(P6,AF)/100)*H3*10^{-3}*W1*10^{6}*24*CF*10^{-6}$$

As stated earlier, the total temperature economic loss LOSS5 is the sum of LOSS1 and LOSS2. Total temperature loss LOSS5, main steam pressure loss LOSS3 and exhaust pressure loss LOSS4 are applied to operator display 76. In this manner, operator 18 is presented, in dollars per day, the economic consequences of operating steam turbine system 30 at a controllable temperature and pressure. The exhaust pressure loss indicates that elements downstream of LP turbine 60 are raising the back pressure and thereby affecting the expansion of the steam through the steam turbine system generally. By altering the control valve position V1, and the input into boiler 14, operator 18 can affect the pressure and temperature of the steam supply to steam turbine system 30 to increase the thermal performance and economic performance of the system. Operator display 76 also indicates electrical power output signal W1 and total control valve position V1 in megawatts and percent respectively.

In other words, the operator may adjust control valve position V1 and input to boiler 14 for increasing the efficiency of the system, when it is determined in accordance with the present invention specified operating parameters, expressed as LOSS1-LOSS5 are greater than a predetermined amount. Typically, a system will perform at optimum efficiency when new (i.e. operational events tend to decrease efficiency, not increase it), which is also the time at which (e.g. initial installation of the system) testing in accordance with the ANSI/ASME PTC 6 - test procedure, or other methods as described above, establishes the design parameters, such as design temperature and pressure values, for the system. Thus, the operator will generally have to increase heat input to the boiler in order to increase steam temperature and/or decrease control valve position V1 in order to increase steam pressure. These adjustments are well known to one of ordinary skill in turbine control. However, it is the timing, or when to change, and the amount of change necessary for the system controls, which may be beneficially effected in accordance with the present invention in order to maintain optimal operating efficiency.

For example, if total temperature loss LOSS5 as displayed to the operator in dollars per day (see FIG. 8), is greater than a predetermined amount (usually specified by the generating plant owners), observation of main steam temperature $T_1$ and reheat steam temperature T4 along with their respective deviation from design values $T_1$-$T_1$DES and $T_4$-$T_4$DES, will indicate that either T1 or $T_4$ is less than design by the appearance of a negative number (say — 50) in the $T_1$-$T_1$DES or $T_4$-$T_4$DES display position, respectively. Thus, the actual temperature will be 950° F. instead of a typical design temperature of 1000° F. The operator would then raise the heat input to the fireside of boiler 14 and/or increase heat to the reheater section of the boiler. If adequate steam temperature can not be obtained for the main steam and/or reheat steam, then the operator would investigate need for boiler soot blowing, which increases heat transfer from the fireside to the steam side within boiler.

For another example, if main steam pressure loss LOSS3 as displayed to the operator in dollars per day (see FIG. 8), is greater than a predetermined amount (usually specified by the generating plant owners), observation of main steam pressure P1 and deviation from design pressure P1-P1DES, will indicate that deviation from design pressure P1-P1DES is negative. Thus, in order to increase main steam pressure P1, the operator may increase heat input to the fireside of the boiler and/or increase feedwater flow to the boiler.

For yet another example, if exhaust pressure loss LOSS4 as displayed to the operator in dollars per day (see FIG. 8), is greater than a predetermined amount (usually specified by the genrating plant owners), the operator could reduce valve position V1, increase flow and/or decrease temperature of circulating water to the condenser, verify proper operation of air ejection equipment (necessary to remove unavoidable leakage of air into condenser as is well known in the art) and/or initiate condenser heat transfer surface cleaning to increase heat transfer between spent steam and circulating water.

For the above examples, controls and procedures necessary to obtain optimal efficiency are well known to the skilled operator. It is the timing (i.e. whether a change in control or corrective action is necessary) and the amount of such change which may be readily determined in accordance with the present invention during system operation without direct measurement of actual steam flow in the system.

FIG. 8 illustrates the operator's display for the operator thermal performance monitor. The operator's display may be a CRT or other human readable mechanism. The components of the operator's display have been explained hereinabove. As is recognized in the art, the data supplied to the operator's display could be continuously recorded on appropriate means by data stored subsystem 28. Also, as well recognized in the art, the operator's thermal performance monitor may be coupled to an electronic control system which directly controls steam turbine system 30. In this view, the control system would have acceptable ranges of economic loss values. If steam turbine system 30 was not operating within those pre-established ranges, the electronic control system would alter the various controllable parameters to bring steam turbine system 30 within the acceptable ranges of operation. The display, in FIG. 8, of measured temperatures, pressures and their corresponding deviation from design simply highlight selected areas in steam turbine system 30. The display also presents P2, P3, P5 and their related deviations from design.

Data processing subsystem 24, illustrated in FIG. 1, also includes a results engineer thermal performance monitor. Generally, the results engineer's thermal performance monitor calculates the actual efficiency of the HP and IP turbine, the deviation from design heat rate for those turbines, and the power loss associated with the steam turbine system operating at an instantaneous supply temperature, and instantaneous reheat temperature, instantaneous supply pressure and an instantaneous exhaust pressure. Due to the results engineer's extensive technical training, education and turbine-generator system experience, he or she, when presented with this information, can recommend maintenance procedures or substantial changes in the overall operation of the steam turbine system 30, boiler 14, condensor 68, and other related elements in the steam turbine plant. Commonly, the results engineer reviews the turbine system performance over a substantially long period of time, such as one week, as compared to the shift operator's supervision of the turbine system operation. Substantially longer periods of time are utilized for long term trend analysis.

Figure 9:
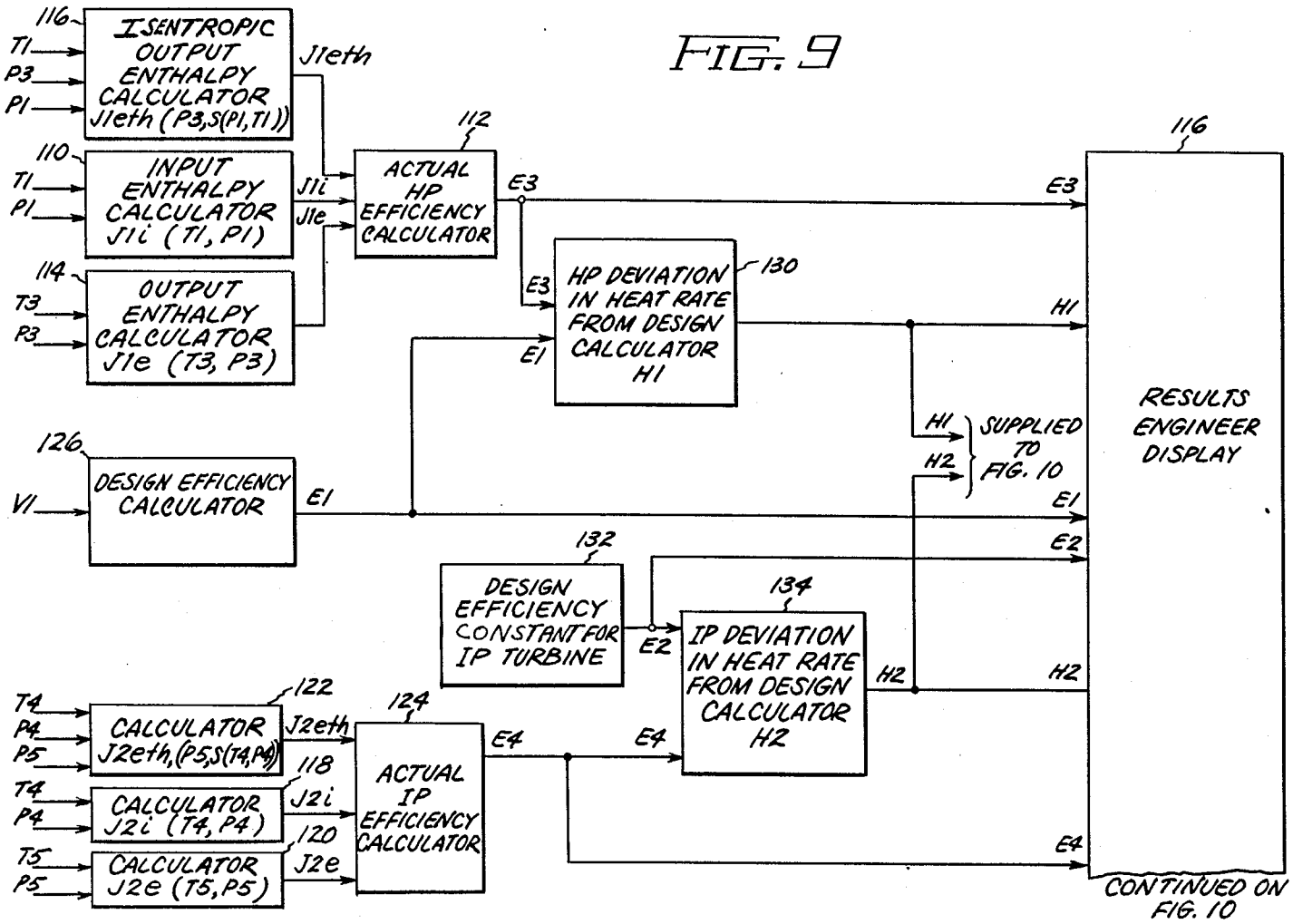
FIG. 9 is a partial flow chart illustrating the functional aspects of the results engineer's thermal performance monitor as part of the data processing subsystem of FIG. 2.

FIG. 9 illustrates a flow chart showing the functional aspects of a portion of he results engineer's thermal performance monitor which is included in data processing subsystem 24. Primarily, FIG. 9 deals with means for calculating the enthalpy of the steam entering and leaving the HP turbine and IP turbine, converting those enthalpy values to efficiency values for the HP and IP turbine, and subsequently calculating the HP and IP deviation in heat rate from design. An input enthalpy calculator 110 obtains temperature T1 and pressure P1 at the inlet of control valve 38. Calculator 110 may include a data base which can be characterized by a Mollier diagram. Hence, the input enthalpy $J1_i$ of the steam is calculated and a signal is applied to an actual HP efficiency calculator 112. An output enthalpy calculator 114 is supplied with T3 and P3, determines the output enthalpy $J1_e$ of the steam, and thereafter applies signal $J1_e$ to calculator 112. The signal $J1_i$ and signal $J1_e$ are calculated on a substantially instantaneous basis with the sensing of the temperatures and pressures. Hence, calculator 112 is continually updating the efficiency signal representative of the operating condition of HP turbine 48.

An isentropic output enthalpy calculator 116 receives T1, P1 and P3. The isentropic enthalpy $J1_{eth}$ is based upon the instantaneous temperature and pressure readings and assumes an adiabatic and reversable process in the steam turbine and the control valve. This calculation is well known in the art and may be obtained from a data base characterized as a Mollier diagram.

Calculator 112 obtains the ratio between the actual enthalpy drop ($J1_i$-$J1_e$) and the isentropic enthalpy drop ($J1_i$-$J1_{eth}$) and generates E3 signal. That actual HP efficiency signal E3 is supplied to a results engineer's display 116 which is part of the results engineer interface subsystem 27 illustrated in FIG. 1.

The efficiency of IP turbine 54 is also of concern to the results engineer. Hence, calculator 118 receives signal T4 and signal P4 sensed at the inlet of IP turbine 54 and determines the input enthalpy $J2_i$ for that turbine. Calculator 120 receives signal T5 and signal P5, representing the condition of the steam exiting IP turbine 54, and determines the output enthalpy signal $J2_e$. Calculator 122 receives signal T4, signal P4 and signal P5 to determine the isentropic output enthalpy $J2_{eth}$ for IP turbine 54. These three enthalpy signals are applied to an actual IP efficiency calculator 124. Calculator 124 subtracts output enthalpy signal $J2_e$ from input enthalpy signal $J2_i$, as well as subtracts the isentropic enthalpy signal $J2_{eth}$ from input enthalpy signal $J2_i$. A ratio of the actual enthalpy drop and isentropic enthalpy drop for IP turbine 54 produces the actual IP efficiency signal E4. E4 is ultimately supplied to results engineer's display 116.

A design efficiency calculator 126 obtains control valve position signal V1 to determine the substantially instantaneous design efficiency of the steam turbine. The design efficiency signal E1 is based upon the above inputs for the steam turbine. Specifically, calculator 126 includes therein a data base formulated by the turbine-generator manufacturer or established during the initial commissioning of the turbine-generator unit. Signal E1 could also be based upon the corrected percentage of steam flow, PCF2, through the turbine system if the boiler 14 did not utilize fossil fuel. One of the methods of determining PCF2 is by the algorithm discussed above in relationship to design heat rate calculator 90 and utilizes V1, P1 and T1 as inputs.

Signal E1 is supplied to HP deviation in heat rate from design calculator 130 as is actual HP efficiency signal E3. Calculator 130 provides means for obtaining the deviation heat rate from design, H1, by subtracting the instantaneous design HP efficiency E1 from the actual efficiency E3 and dividing the resultant by the instantaneous design efficiency E1 and a conversion factor. The algorithm for the HP deviation in heat rate signal H1 is as follows:

$$H1 = -(100*((E3-E1)/E1))/6.7$$

The H1 signal is applied to result engineer's display 116. The divisor 6.7 depends upon the specific turbine design, and hence is exemplary only.

A design efficiency constant 132 for the IP turbine 54 is supplied by the turbine manufacturer as an installation dependent constant E2. It is well known in the art that the IP turbine's design efficiency is substantially constant due to the absence of valves or other devices obstructing the flow of steam therethrough. A person of ordinary skill in the art recognizes that the IP design efficiency is constant over the substantially entire range of steam flow. Design efficiency signal E2 is supplied to an IP deviation in heat rate from design calculator 134. Also supplied to calculator 134 is actual IP efficiency signal E4. Calculator 134 subtracts signal E2 from signal E4, divides the resultant by signal E2 and multiplies by a conversion factor to generate the IP deviation in heat rate from design signal H2. One algorithm for H2 follows:

$$H2 = -(100*((E4-E2)/E2))/10)$$

Signal H2 is supplied to results engineer's display 116 as is signal E2 and signal E4. The factor 10 is exemplary only and relates to a specific turbine system. As illustrated in FIG. 9, both the HP deviation from design signal H1 and IP deviation from design signal H2 are transmitted to other elements functionally shown in FIG. 10.

Figure 10:
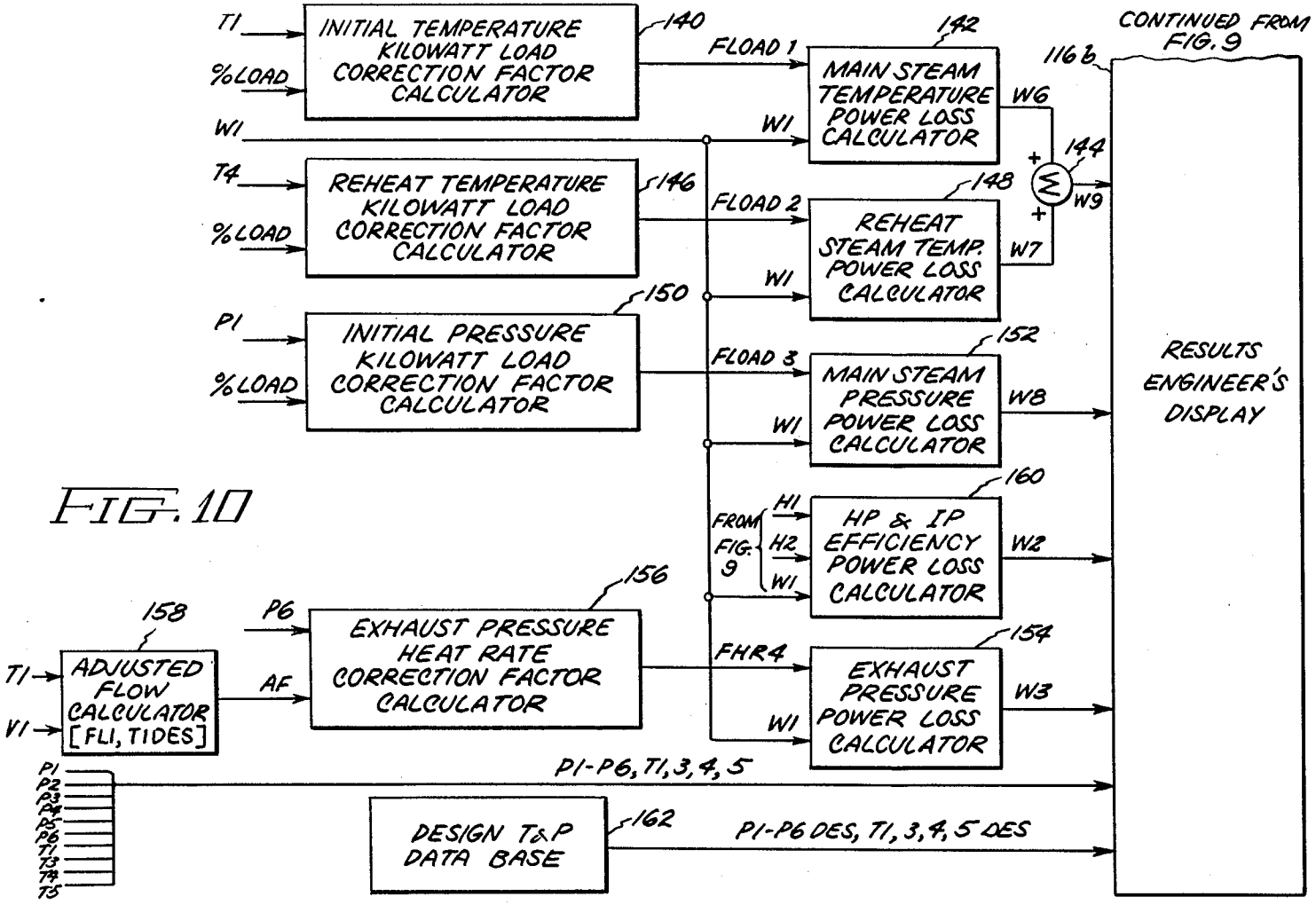
FIG. 10 is the balance of the flow chart shown in FIG. 9, which further illustrates the functional aspects of a result engineer's monitor.

FIG. 10 is a flow chart illustrating the remaining portion of the results engineer's thermal performance monitor. Basically, FIG. 10 relates to the power losses associated with operating the steam turbine system 30 at controllable temperatures and pressures which may differ from design values.

An initial temperature kilowatt load correction factor (FLOAD1) calculator 140 is supplied with T1 and the percentage of rated load signal %LOAD. The function for determining factor FLOAD1 is an expression based upon the deviation of temperature T1 from the design temperature T1DES which results in a percentage change in the design heat rate value for the turbine system. The slope of this initial temperature power expression is affected by %LOAD signal. One FLOAD1 function is graphically illustrated in FIG. 4 by the lines extending from the upper left quadrant to the lower right quadrant. In a similar fashion to the initial temperature heat rate correction factor function, FHR1, described in relationship to calculator 80 of FIG. 3, the function is based on theoretical calculations which are confirmed by field tests on actual turbine systems.

The signal FLOAD1 is applied to a main steam temperature power loss, W6, calculator 142. Calculator 142 is supplied with the electrical power output signal W1 and one method of calculating W6 is as follows:

$$W6=(FLOAD1(T1,\%\ LOAD)/100)*W1$$

Signal W6 may be directly applied to results engineer's display 116*b* or may be supplied to summer 144 as illustrated in FIG. 10.

A reheat temperature kilowatt load correction (FLOAD2) factor calculator 146 is supplied with T4 and %LOAD. The function for determining the FLOAD2 factor is an expression based upon the deviation of temperature T4 from a reheat design temperature value T4DES which results in a percentage change in the design heat rate value for the turbine system. The FLOAD2 function is graphically illustrated in FIG. 5 and is generated substantially similar to FHR2, FLOAD1 and FHR1.

The FLOAD2 signal is supplied to a reheat steam temperature power loss, W7, calculator 148 as is signal W1. Calculator 148 divides the FLOAD2 factor by a correction factor and multiplies by signal W1 as follows in one exemplary algorithm:

$$W7=(FLOAD2(T4,\%\ LOAD)/100)*W1$$

Signal W7 is supplied to summer 144 wherein that signal is added to signal W6 to provide a total temperature power loss signal W9. Signal W9 is ultimately presented to results engineer's display 116*b*.

An initial pressure kilowatt load correction factor (FLOAD3) calculator 150 obtains P1 and %LOAD. The function for determining the signal FLOAD3 is an expression based upon the deviation of signal P1 from P1DES which results in a percentage change in the design heat rate value for the steam turbine system. In a similar fashion to the initial pressure heat rate correction factor FHR3, the FLOAD3 factor has a slope which is affected by the percentage of rated load signal. One example of the initial pressure correction factor as it relates to changes in kilowatt load is graphically illustrated in FIG. 6. It is to be recognized that the FLOAD1 factor, the FLOAD2 factor and the FLOAD3 factor functions are established in the same manner as the corresponding heat rate correction factors discussed earlier.

The FLOAD3 signal is applied to a main steam pressure power loss, W8, calculator 152 as is signal W1. Calculator 152 provides means for determining signal W8 by dividing FLOAD3 signal by a conversion factor and multiplying by signal W1 as follows:

$$W8=-(FLOAD3(P1,\%\ LOAD)/100)*W1$$

Signal W8 is applied to display 116*b*.

A poor exhaust pressure power loss signal W3 indicates to the results engineer a power loss based upon unduly high turbine exhaust pressure due to elements in the system downstream of LP turbine 60. Signal W3 is generated by an exhaust pressure power loss calculator 154 which receives signal W1 and the exhaust pressure heat rate correction factor signal FHR4. The exhaust pressure heat rate correction factor signal FHR4 is generated by an appropriate calculator 156. Calculator 156 and an adjusted flow, AF, calculator 158 are substantially similar to calculator 86 and calculator 88 of FIG. 3. It should be appreciated that the results engineer's thermal performance monitor may be independent from the operator's thermal performance monitor or may be combined with the operator's monitor. In the latter situation, duplication of calculator 158 and 156 would be unnecessary. One algorithm to obtain W3 is as follows:

$$W3=[FHR4(P6,AF)/(100+FHR4(P6,AF))]*W1$$

An HP and IP turbine efficiency power loss calculator 160 receives the HP deviation in heat rate from design signal H1 and the IP deviation in heat rate from design signal H2 as illustrated in FIG. 10. Signal W1 is also supplied to calculator 160. An HP and IP turbine efficiency power loss signal W2 is calculated by multiplying signal H1 by a conversion factor, adding to the resultant signal H2 and by multiplying the resulting sum by signal W1 and another conversion factor. One equation for deriving the HP and IP efficiency power loss signal W2 is as follows:

$$W2=((1.7*H1)+H2)*(W1/100)$$

Signal W2 is supplied to display 116*b*. The 1.7 conversion factor in the above equation is related to the specific turbine system. That factor illustrates that the HP deviation in heat rate from design contributes more to a power loss than the IP deviation in heat rate from design. This greater effect is noted because smaller enthalpies within the HP turbine, as reflected in H1, reduce the enthalpy which can be added to the steam in the reheater. Hence, the energy which can be extracted from the steam by the IP turbine is reduced.

Design temperature and pressure data base 162 supplies the design pressure and temperatures to the result engineer's display 116*b*. Also supplied to the results engineer's display 116*b* are all the sensed pressures and temperatures P1, P2, P3, P4, P5, P6 and T1, T3, T4 and T5. The origin of these sensed signals are clearly shown in FIG. 2.

FIG. 11 generally illustrates a result engineer's display which presents the control valve position V1, the design efficiencies E1 and E2, the actual efficiencies E3 and E4, the deviation in heat rate from design H1 and H2, as well as the various power loss signals W9, W8, W2, and W3 and their relationship to the measured load or the electrical power output signal W1.

A person of ordinary skill in the art recognizes that the turbine-generator system can be operated beyond its recommended design parameters, i.e., T1 and P1 can be higher than T1DES and P1DES. Carrying this point further, the system can be operated at higher efficiencies which result in negative economic losses (as in the operator's monitor) and in negative power losses (as in the results engineer's monitor). The monitor(s) discussed and claimed herein are meant to cover such a situation.

It is to be recognized that the operator's thermal performance monitor and the results engineer's thermal performance monitor may be combined into one general thermal performance monitor. One of ordinary skill in the art would recognize the feasibility of such a combination. The claims appended hereto are meant to cover such a general thermal performance monitor.

Throughout the dicussion of the embodiment of the present invention, steam turbine system 30 included HP turbine 48, IP turbine 54, and LP turbine 60. One of ordinary skill in the art would recognize that other steam turbine systems could utilize the turbine thermal performance monitor as disclosed herein. In fact, a single steam turbine could be driving an electromagnetic generator and the thermal performance monitor could operate in conjunction with that single steam turbine. For clarity the foregoing discussion only focused on a three turbine system. However, some of the claims appended hereto relate to a single turbine system. To differentiate between the various signals in either system, lower case letters identify signals in the single turbine system and upper case letters identify signals in the multiple turbine system. For example, in the single turbine system, the first temperature is designated "t1" and the first substantially instantaneous design efficiency is designated "e1". In contrast, the corresponding signals in the multiple turbine system are designated "T1" and "E2" respectively. This nomenclature is used for clarity and is not meant to be limiting in any sense.

From another perspective, a turbine system may include two or more high pressure steam turbines mechanically coupled to an intermediate pressure turbine and a low pressure turbine and ultimately coupled to a electric generator. One of ordinary skill in the art could utilize the present invention by adding appropriate means to include this additional turbine's performance into the thermal performance monitor. The claims appended hereto are meant to cover such a steam turbine system.

Although several sensors are discussed to obtain P,T signals herein, it should be recognized that conditioning means or other fail-safe means could be utilized with the sensors to insure the integrity of the inputs into the thermal performance monitor. These conditioning means could be adjusted periodically, such as annually, to correct the raw P,T data.

One of ordinary skill in the art will recognize that many types of electrical devices could be utilized as a thermal performance monitor disclosed herein. In one embodiment, a Hewlett Packard HP 1000 minicomputer associated with a set of Fortran subroutines was utilized. In a second embodiment, an Intel 8086 microcomputer, manufactured by Intel Corporation, was utilized with the Fortran subroutines. However, it is to be understood that even though several working embodiments utilized digital electronic equipment, the operation of a completely analog thermal performance monitoring device could be developed by one of ordinary skill in the art as disclosed herein.

The claims appended hereto are meant to cover all modifications apparent to those individuals of ordinary skill in the art. The recognition of various constants, proportionalities, numbers and conversion factors stated in the claims is not meant to be limiting.

What is claimed is:

1. In a power plant including a steam generator, a steam turbine and an electric generator, a monitoring and display system providing a different data output to one of an operator display and an engineer display, the monitoring system comprising:

(i) means for sensing power plant current operating conditions such as steam temperatures, steam pressures, inlet valve positions, and electric generator outputs;

(ii) an operator thermal performance monitor connected to the operator display comprising:

(a) a deviation from design calculator for determining differences between the current measured operating conditions of temperature and pressure and the design operating conditions of temperature and pressure, said deviation from design calculator output connected to the operator display, (b) an economic loss calculator for determining the money loss per unit time based upon inputs related to heat rate in the steam turbine, the steam turbine exhaust, a system design heat rate and electrical output, said economic loss calculator output connected to the operator display; whereby, the operator display includes: valve position; money loss per unit time; measured generator output or load; measured pressure and temperature; and, deviations of measured temperature and pressure from design temperatures and pressures;

(iii) an engineer thermal performance monitor connected to the engineer display comprising:

(a) a turbine efficiency calculator for determining actual turbine efficiency based upon enthalpy;

(b) a design efficiency calculator for determining an ideal turbine efficiency based upon measured operating conditions;

(c) a deviation from heat rate calculator for comparing actual turbine efficiency with the ideal turbine efficiency;

(d) means for calculating main steam temperature power loss; means for calculating main steam pressure power loss; means for calculating turbine efficiency power loss and means for calculating exhaust pressure power loss all connected into the engineer display along with inputs related to actual and design temperature and generator load; whereby, the engineer display includes: valve position, design efficiency; actual efficiency; deviation from heat rate calculation; power loss calculations, measured load and temperature/pressure readouts.

2. The monitoring and display system recited in claim 1 wherein the operator display includes information primarily useful for making immediately corrections in power plant operation whereas the engineer display includes information primarily useful to longer term operation of a power plant.

3. The monitoring and display system recited in claim 1 wherein there is at least one high pressure turbine and at least one reheat pressure turbine and wherein the turbine monitoring and display system further includes:

means for sensing reheat turbine input temperature and pressure and means for sensing reheat output temperature and pressure;

a reheat temperature heat rate correction factor calculator for determining a percentage change in the heat rate based upon deviation from design temperature at a percent load or a reheat steam temperature loss; an initial temperature heat rate correction factor calculating likewise calculating a main stream temperature loss; means in said economic loss calculator for combining the main steam temperature loss and reheat steam temperature loss to determine a total temperature loss signal as presented on the operator display.

4. The monitoring and display system recited in claim 1 wherein there is at least one high pressure turbine and at least one reheat or intermediate pressure turbine and wherein the turbine monitoring and display system further includes:

means for sensing reheat or intermediate turbine input temperature and input pressure and means for sensing reheat or intermediate turbine output temperature and output pressure;

means for calculating actual reheat or intermediate turbine efficiency based upon enthalpy calculations;

means for supplying a design efficiency constant for said reheat or intermediate pressure turbine and inputting said turbine actual efficiency and said design constant into another heat rate deviation from design calculator to determine the reheat turbine percent deviation from design;

means for combining the percentage deviation from heat rate for the high pressure turbine and the percentage deviation from heat rate for the reheat turbine with a signal representative of total plant power output to determine the combined turbine efficiency power loss which is reported on the engineer display.

5. The monitoring and display system recited in claim 1 wherein the operator monitor and the engineer monitor are part of a data processing subsystem.

* * * * *